US006194646B1

(12) United States Patent
Kowalski

(10) Patent No.: US 6,194,646 B1
(45) Date of Patent: Feb. 27, 2001

(54) MUSICAL KEYBOARDS PLAYING NEW KINDS OF MUSIC

(76) Inventor: Andrzej Kowalski, ul Konduktorska 1a m. 43, PLOO -775 Warsaw (PL)

( * ) Notice: Subject to any disclaimer, the term of this patent is extended or adjusted under 35 U.S.C. 154(b) by 0 days.

(21) Appl. No.: 09/270,144

(22) Filed: Mar. 16, 1999

Related U.S. Application Data

(60) Provisional application No. 60/074,321, filed on Feb. 11, 1998.

(51) Int. Cl.[7] ..... G10C 3/12

(52) U.S. Cl. ..... 84/423 R; 84/424; 84/425; 84/427; 84/428; 84/451

(58) Field of Search ..... 84/423 R, 424, 84/425, 427, 428, 451

(56) References Cited

U.S. PATENT DOCUMENTS 5,430,913 * 7/1995 Kotschy ..... 84/423 R
5,516,981 * 5/1996 Nagai ..... 84/615
5,549,029 * 8/1996 Lepinski ..... 84/483.2

FOREIGN PATENT DOCUMENTS

8316109 * 1/1985 (AU) .

* cited by examiner

*Primary Examiner*—Robert E. Nappi
*Assistant Examiner*—Shih-yung Hsieh
(74) *Attorney, Agent, or Firm*—Erik M. Arnhem

(57) ABSTRACT

A new musical keyboard and musical scale is provided by subdividing each octave into a larger number of parts, or notes. In one case, each octave contains sixteen notes, rather than the conventional twelve. In another case, each octave contains twenty notes. The new musical system enables new musical sounds and special effects to be created.

2 Claims, 1 Drawing Sheet

MUSICAL KEYBOARDS PLAYING NEW KINDS OF MUSIC

Based on Provisional Patent Application S. No. 60/074, 321 filed Feb. 11, 1998.

BACKGROUND OF THE INVENTION

There are many scale systems (or modes) for musical instruments. In most musical scale systems, the scale is divided into octaves. Each octave contains a number of separate notes spaced approximately evenly within the frequency range making up the octave.

An octave is a halving or doubling of frequency, based on the characteristics of the human ear. It is generally agreed that for each leap of one octave we seem to hear the same note again, of higher or lower pitch, but nevertheless merging perfectly with the original note spaced an octave away.

The conventional piano keyboard contains approximately seven octaves, with each octave containing twelve notes. There are eighty eight keys on the piano keyboard, comprising fifty two white keys and thirty six black keys. The frequency span of the eighty eight keys (notes) is from about thirty two hertz to about forty one hundred eighty six hertz, with each octave doubling the frequency span of the next lower octave. The spacing of the notes in the higher octaves is necessarily greater than the note spacing in the lower octaves, due to the fact that the higher octaves contain higher frequency ranges.

The present invention contemplates a musical scale and keyboard system, wherein the number of notes in each octave is increased from twelve to sixteen (in one case) or twenty (in a second case).

The primary object of my invention is the creation of new kinds of music sounds, which necessarily entail the concept of novel types of musical keyboards.

The present disclosure refers to two novel scales applying specifically to a new set of keys, e.g. on pianos, causing the creation of completely new sounds of music which, for example, may introduce "special effect sounds". Such sounds may lend themselves to, e.g. composing music for science fiction movies.

The new music sounds are produced on musical keyboards when one octave is divided into 16 or 20 equal parts, in contrast to the conventional keyboards where each octave is divided into only 12 equal parts. The hitherto known and used musical scales are not capable of producing the music sounds, as contemplated according to the present invention. These additionally created sounds producible on the new keyboards in conjunction with the musical instruments adapted thereto, result in an approximately eighty percent increase over known sound effects. In other words, the enlarged keyboards offer composers an opportunity to create, in combination, completely new musical sounds.

The new musical scale and keyboard systems reduce the note spacing in each octave, so as to improve the frequency consonance between notes played simultaneously on different musical instruments. The reduced note spacing also reduces the effect of slightly mistuned (or differently tuned) musical instruments that are played together.

DETAILED DESCRIPTION OF THE INVENTION

Figure 1:
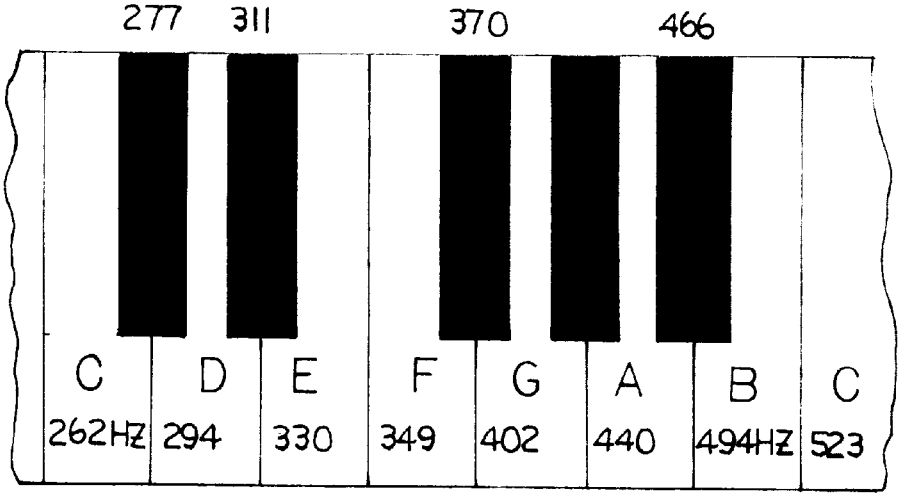
FIG. 1 (PRIOR ART)
FIG. 1 illustrates a portion of the presently exisiting piano keyboard according to (prior art) practice.

The creation of new music by the operation of the applicable musical keyboards is explained as follows:

In music the basic sound is "a" on the middle octave (in a seven octave system). Using the tuning fork "a" has a 440 Hz frequency.

Each "a" sound from successive octaves has frequencies two, four and eight times higher, or two, four eight times lower than the first octave (440 Hz frequency).

The octave, now, is divided into twelve parts—semitones. The frequency of each sound, being one semitone higher, is a product of the frequency of the sound and the constant number q=1.059463094. In mathematics, it is said that the frequency of the successive semitones are the successive elements of the geometrical sequence. Each octave starting from sound "C" has, respectively frequencies of "C" sounds as follows:

"Big" octave 65.40639131 Hz;

"Small" octave 130.8127826 Hz;

"First" octave 261.6255652 Hz;

"Second" octave 523.2511305 Hz;

"Third" octave 1046.502261 Hz;

"Fourth" octave 2093.004522 Hz

In practice, the frequency of each "C" sound is rounded off.

As to the new music of the present invention, according to one embodiment each octave from the first "C" to successive ones may be divided into twenty equal parts; however, in the new arrangement of octaves the value of the number q is now q1=1.035264924.

Figure 2:
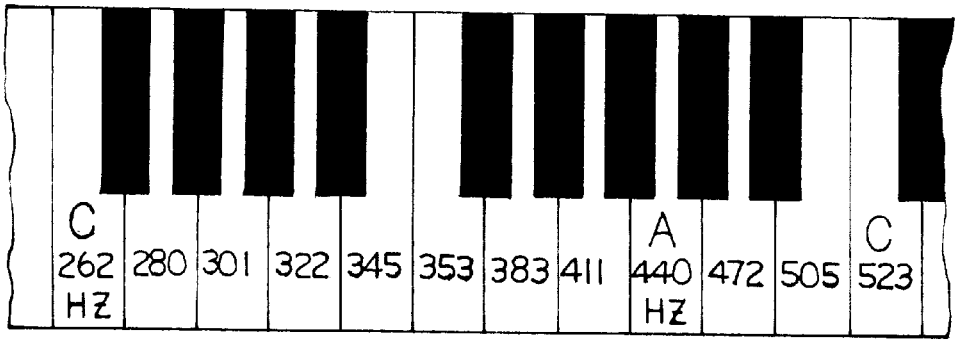
FIG. 2 shows a partial plan view of a keyboard, capable of producing twenty sounds per octave, according to the present invention.

FIG. 2 shows fragmentarily a portion of a piano keyboard containing one octave subdivided into twenty notes spaced substantially equally within the frequency span of that octave. The other six octaves (not shown) contain twenty notes spaced substantially equally within the particular frequency range of the respective octave.

Figure 3:
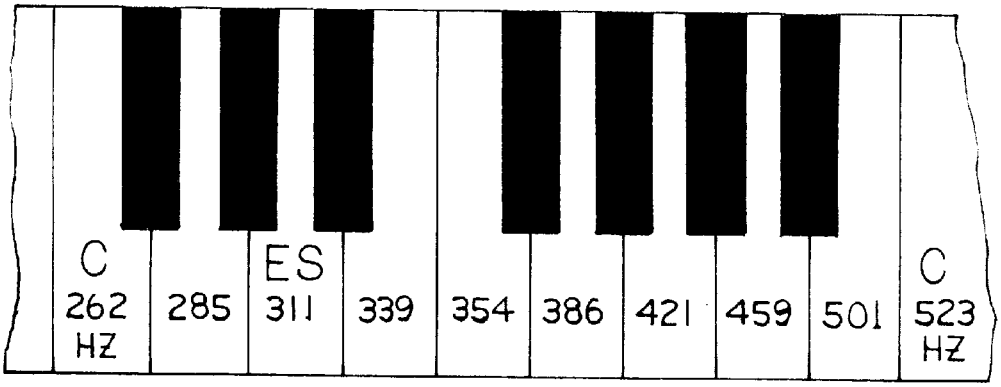
FIG. 3 is a partial plan view of a keyboard, capable of producing sixteen sounds per octave, according to the present invention.

FIG. 3 fragmentarily shows a second keyboard, wherein each octave is divided into sixteen essentially equal parts (or notes). In this case the note (semitone) spacing is somewhat greater than in the case of FIG. 2, but still appreciiably less than in the case of FIG. 1. In FIG. 3, the value q3 is 1.0442731782.

The values of numbers q1 and q2, dividing the octave into sixteen or twenty parts, respectively result in that sounds "C" "es" "fis" and "a", are sounds indentical to the presently existing keyboards, but the increase of keys on the novel keyboards, according to my invention produces new sounds and result in the creation of new kinds of music.

With the musical system of FIGS. 2 or 3, the written music has to use a greater number of bars in order to provide places for all of the notes in a given octave. In the conventional musical system, the written notes use five parallel bars to provide the space for twelve notes. With the musical system of FIGS. 2 or 3, it is necessary to provide a greater number of bars on the musical sheet in order to have sufficient space for all of the notes in a given octave. In a system having sixteen notes per octave, eight bars are required. In a system having twenty notes per octave, twenty bars are required.

The new musical system contains the same number of octaves and the same total frequency range as the conventional twelve note per octave system (i.e. seven octaves and a total frequency span from about thirty two hertz to about forty one hundred eighty six hertz). The new musical system differs from the conventional system in that each octave is divided into a greater number of notes (parts); e.g. sixteen notes per octave or twenty notes per octave.

As shown in FIGS. 2 and 3, the newly devised keyboard contains black and white keys interspersed so that each black key is located between two white keys; each key forms a different note (i.e. different audible frequency). The sound frequency of each black key is approximately midway between the sound frequencies of the two contiguous white keys located on either side of the respective black key.

The invention does not require changes in the way musical instruments are constructed or fabricated. Instruments using the new musical scale or keyboard will be constructed on the same principles as instruments produced heretofore.

What is claimed:

1. A keyboard comprising black and white keys interspersed so that each one of said black keys is located between two of said white keys;

each one of said keys forming a different note;

said keys being separated on a musical scale so as to provide n keys per an octave;

said keys being grouped together so that said octave includes two groups of said keys: a left group and a right group, with said left group containing said black keys among said white keys, and said right group containing said black keys among said white keys and each right group having one black key and one white key more than each left group; and wherein there are sixteen of said keys per said octave; said left group containing three of said black keys among four of said white keys, and said right group containing four of said black keys among five of said white keys.

2. The keyboard of claim 1, wherein there are twenty of said keys per said octave; with each left group containing four of said black keys among five of said white keys and each right group containing five of said black keys among six of said white keys.

* * * * *